United States Patent [19]

Pentney

[11] 4,030,598

[45] June 21, 1977

[54] DISPENSING CONTAINER FOR RAZOR BLADE UNITS

[75] Inventor: Harry Pentney, Spencers Wood, England

[73] Assignee: The Gillette Company, Boston, Mass.

[22] Filed: Apr. 29, 1976

[21] Appl. No.: 681,563

[30] Foreign Application Priority Data

Apr. 29, 1975 United Kingdom ..... 17795/75

[52] U.S. Cl. ..... 206/356; 30/40.2

[51] Int. Cl.[2] ..... B65D 83/10

[58] Field of Search ..... 221/69, 87, 89, 92, 221/279, 280, 34, 35, 56, 58, 59, 131; 206/352, 354–360; 30/40–40.2; 312/50, 71

[56] References Cited

UNITED STATES PATENTS

| | | | |
|---|---|---|---|
| 2,776,743 | 1/1957 | Treiss | 221/34 |
| 3,543,918 | 12/1970 | Waterman et al. | 221/102 |
| 3,834,018 | 9/1974 | Dawidowica et al. | 206/359 |
| 3,854,201 | 12/1974 | Dawidowica et al. | 206/356 |

*Primary Examiner*—Robert B. Reeves
*Assistant Examiner*—H. Grant Skaggs
*Attorney, Agent, or Firm*—Richard A. Wise; Oistein J. Bratlie; Scott R. Foster

[57] ABSTRACT

A dispensing container for razor blade units, the container comprising a plurality of compartments, each compartment adapted to releasably retain a shaving unit.

1 Claim, 5 Drawing Figures

DISPENSING CONTAINER FOR RAZOR BLADE UNITS

This invention provides a new or improved container for protecting double-edged razor blade units during storage and transport and allowing ready dispensing of the units when required for use.

More particularly, the invention provides a dispensing container for razor blade units, comprising a plurality of separate compartments arranged side-by-side for the storage of individual blade units, each compartment having opposed side walls, a rear wall, a dispensing opening at its forward end, the side walls having inturned flange portions, depending abutment means extending partially across the opening and spring means for biasing a blade unit upwardly so that its lateral margins are urged against the underside of the flange portions and its front edge is aligned with the abutment means, the spring means being displaceable by manual pressure applied to an upper surface of the unit exposed between the flange portions to permit the unit to be depressed below the level of the depending abutment means and slid forwardly out of the container compartment.

The particular dispensing container in accordance with the invention which is shown in the accompanying drawing and described below is intended for use with blade units of the construction described in U.S. Pat. application Ser. No. 618,568; filed Oct. 1, 1975 in the name of Edward E. Pomfret. It will be apparent, however, that with appropriate modifications of form and dimensions the container can be adapted to accommodate blade units of other constructions.

Figure 1:
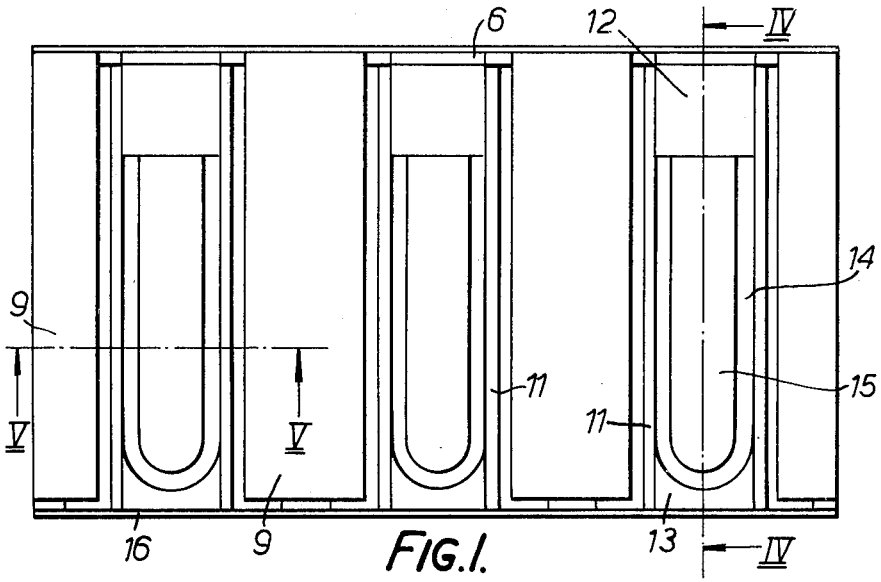
FIG. 1 is a plan view of the dispensing container.
Figure 2:
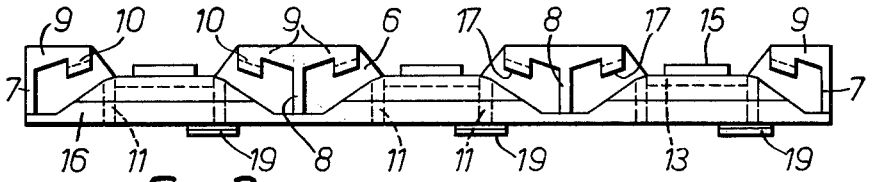
FIG. 2 is a front elevation thereof.
Figure 3:
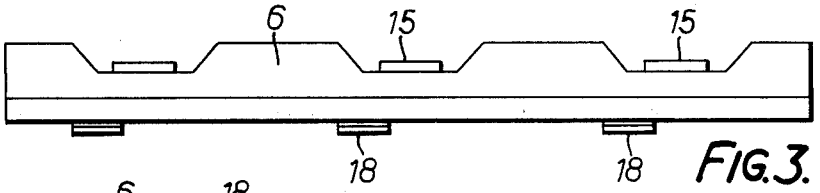
FIG. 3 is a rear elevation thereof.
Figure 4:
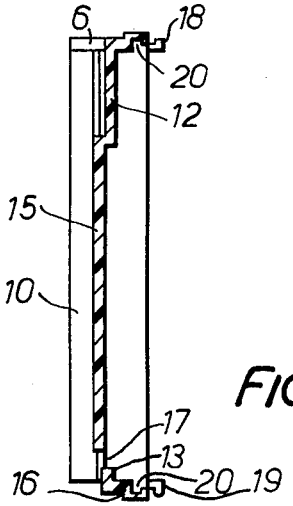
FIG. 4 is a sectional side elevation taken on the line IV—IV of FIG. 1.
Figure 5:
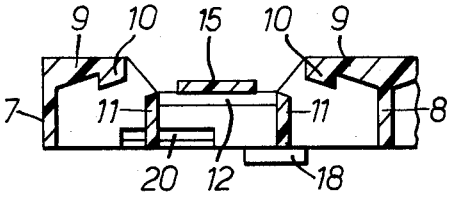
FIG. 5 is a part sectional view taken on the line V—V of FIG. 1.

The dispensing container illustrated is so designed that it can be formed as an integral one-piece molding of thermoplastic material in a mold of simple construction. It accommodates three blade units disposed in side-by-side relation, but can readily be modified to accommodate a smaller or larger number of units. Moreover, it is so designed that it can be coupled back-to-back with a second identical molding to form a container accommodating twice the number of units, in this case six.

Assuming for purposes of description that the container is disposed in the attitude illustrated, the unitary molding comprises a vertical rear wall 6 from which there project forwardly four equally spaced, parallel, vertical webs 7 and 8, which constitute the side walls of three compartments. Projecting inwardly from the upper edge of each of the outer webs 7 (which constitute the side walls of the container) is a flange 9 having at its extremity a depending rib 10. Similar flanges 9 carrying ribs 10 project to each side of the two intermediate webs 8. In each of the three spaces left between adjacent webs 7 and 8 there extend forwardly from the rear wall two parallel, vertical rails 11, of lesser height than the webs 7 and 8 and constituting upstanding projections. The upper edges of the rails 11 are connected together at their rear and front ends by horizontal portions 12 and 13, respectively, and in the opening 14 left between these portions there is disposed a forwardly extending spring tongue 15, united at its rear end with the portion 12, but otherwise free. The front edges of the rails 11, of the portions 12 and of the lower parts of the webs 7 and 8 are integrally united with a front wall 16, so that all these parts, with the rear wall 6, form a substantially rigid framework having adequate strength to protect the blade units stored in it.

Each of the three blade units (not illustrated) stored in the container illustrated is disposed with its horizontal central portion disposed above the rails 11 (and the portions 12 and 13 interconnecting them) and is urged upwardly by the spring tongue 15, so that its downwardly inclined side portions are pressed against the undersides of the ribs 10, forward movement of the blade unit being prevented by downwardly projecting abutment means in the form of teeth 17 formed at the front ends of the ribs 10. While the cutting edges of each blade unit are fully protected by the webs 7, 8 and the flanges 9, the central horizontal portion of the unit is exposed between the flanges 9. By pressing down on this portion, against the action of the tongue 15, the unit can be brought to bear on the upper edges of the rails 11 (which, like the undersides of the ribs 10, are bevelled to match the downward inclination of the side portions of the unit) and in this position the unit is clear of the teeth 17 and can be slid forwardly along the rails out of the storage container.

The rear wall 6 of the container is formed with three depending lugs 18 of L section and the front wall 16 is formed with three somewhat similar lugs 19 whose flanges are rounded off. The two walls 6 and 16 are also formed with recesses 20, positioned to register with the lugs of the corresponding wall of a precisely similar container, when the two containers are positioned with their undersides together. When the lugs 18 and the recesses 20 of the two rear walls are interengaged and the two containers are pressed together, the moldings yield sufficiently to allow the lugs 19 of each front wall to snap into the recesses 20 of the other front wall, thus coupling the two moldings together to form a container for six blade units.

In the appended claims, the dispensing container is defined in terms which assume it to be in the horizontal attitude illustrated in the drawing, but it will be appreciated that this orientation is assumed for purposes of convenience and clarity and not in any limiting sense.

Having thus described my invention, what I claim as new and desire to secure by Letters Patent of the United States of America is:

1. A molded plastic one-piece dispensing container for razor blade units having blade means permanently fixed to a head portion including guard and cap members, said container comprising a plurality of compartments arranged side-by-side for the storage of blade units, each of said compartments having opposed side walls, a rear wall, a front wall with a dispensing opening, said side walls having inturned flange portions, abutment means depending from said flange portions and extending partially across said opening, and spring means for biasing said blade units so that margins thereof are urged against an underside of said flange portions and a front edge thereof is aligned with said abutment means, said spring means comprising a leaf spring molded integrally with and extending from said rear wall and between upstanding projections which limit downward displacement of a blade unit located in said compartment, said leaf spring being displaceable by manual pressure applied to an exposed cap member of a blade unit to permit said blade unit to be depressed below the level of said depending abutment means and slid forwardly out of said container compartment.

* * * * *